US011247833B2

(12) United States Patent
Kitano et al.

(10) Patent No.: US 11,247,833 B2
(45) Date of Patent: Feb. 15, 2022

(54) STORAGE BOX

(71) Applicant: Panasonic Intellectual Property Management Co., Ltd., Osaka (JP)

(72) Inventors: Tomoaki Kitano, Nara (JP); Masahiro Kagimoto, Shiga (JP); Hideji Kawarazaki, Osaka (JP); Shinya Kojima, Kyoto (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 76 days.

(21) Appl. No.: 16/548,881

(22) Filed: Aug. 23, 2019

(65) Prior Publication Data

US 2020/0079570 A1 Mar. 12, 2020

(30) Foreign Application Priority Data

Sep. 6, 2018 (JP) ..... JP2018-166522

(51) Int. Cl.
*B65D 81/18* (2006.01)
*B65D 81/38* (2006.01)

(52) U.S. Cl.
CPC ..... *B65D 81/18* (2013.01); *B65D 81/3825* (2013.01)

(58) Field of Classification Search
CPC .... B65D 81/18; B65D 81/24; B65D 81/3825; B65D 81/3834; B65D 81/3858; F25D 3/00; F25D 3/08
See application file for complete search history.

(56) References Cited

U.S. PATENT DOCUMENTS 5,595,069 A * 1/1997 Gies ..... B65D 81/3883 62/530
5,934,100 A * 8/1999 Hornick ..... F25D 3/08 62/457.4
6,276,164 B1 * 8/2001 Santa Cruz ..... B65D 81/3886 62/372
2010/0083421 A1 * 4/2010 Cho ..... C09K 5/063 2/171.2
2013/0221013 A1 * 8/2013 Kolowich ..... B65D 81/3872 220/592.17
2013/0291584 A1 * 11/2013 Chapman, Jr. ..... F25D 3/08 62/371
2014/0331711 A1 * 11/2014 Blezard ..... B65B 63/08 62/457.2
2015/0330697 A1 * 11/2015 Tanaka ..... B65D 81/3813 62/457.2
2018/0220819 A1 * 8/2018 Alexander ..... A47G 19/2288
2018/0328644 A1 * 11/2018 Rizzo ..... F25D 3/08

FOREIGN PATENT DOCUMENTS

GB 2556358 A * 5/2018 ..... F25D 3/06
JP 2013-010523 1/2013

* cited by examiner

*Primary Examiner* — Emmanuel E Duke
(74) *Attorney, Agent, or Firm* — Hamre, Schumann, Mueller & Larson, P.C.

(57) ABSTRACT

A storage box includes a wall including: a packaging member; and a heat transfer body and a cold storage agent that are stored in the packaging member. The cold storage agent is disposed closer to an outer surface of the storage box than the heat transfer body is. Consequently, a chill from the cold storage agent spreads over the heat transfer body, and the chill is transferred to an inside of the storage box through the heat transfer body. Thus, a temperature can be more homogeneously maintained in the storage box.

9 Claims, 5 Drawing Sheets

STORAGE BOX

BACKGROUND

1. Technical Field

The present disclosure relates to a storage box, particularly to a storage box suitable for management of a storage object at a desired temperature.

2. Description of the Related Art

Conventionally, a heat insulation container is used to manage a storage object in a desired temperature range. For example, a heat insulator such as a vacuum heat insulating material is used as the heat insulation container, and the storage object can be kept in the desired temperature range (for example, see Unexamined Japanese Patent Publication No. 2013-10523).

When the storage object is an investigational drug, it is necessary to keep the investigational drug in the temperature range of, for example, 2° C. to 8° C. However, when the storage object is out of the temperature range at a certain place even if the storage object is within the temperature range at another place in the storage box, the storage object is made disposal. Thus, it is important to prevent a temperature distribution in the storage box as much as possible.

As to the temperature distribution in the storage box, generally a large temperature difference is generated between the temperatures of a top surface portion and a bottom portion of the storage box, and the temperature of the top surface portion is higher than the temperature of the bottom portion.

SUMMARY

The present disclosure provides a storage box that can more homogeneously keep the temperature inside a storage box by preventing a temperature difference.

A storage box of the present disclosure includes a wall including: a packaging member; and a heat transfer body and a cold storage agent that are stored in the packaging member. The cold storage agent is disposed closer to an outer surface of the storage box than the heat transfer body is.

DETAILED DESCRIPTION

According to an aspect of the present disclosure, a storage box includes a wall including: a packaging member; and a heat transfer body and a cold storage agent that are stored in the packaging member. The cold storage agent is disposed closer to an outer surface of the storage box than the heat transfer body is.

Consequently, a chill from the cold storage agent spreads over the heat transfer body, and the chill is transferred to an inside of the storage box through the heat transfer body. Thus, the temperature can be more homogeneously maintained in the storage box.

In the storage box according to another aspect of the present disclosure, the storage box may include at least two walls adjacent to each other, the at least two walls being the wall. The at least two walls may be detachably attached together at sides adjacent to each other by the packaging member of each of the at least two walls or a fixing member.

Consequently, the storage box can be folded, and when the cold storage agent is cooled, the storage box can be put in a cooling device while being folded. Accordingly, a space in the cooling device can be effectively used. When the cold storage agent is cooled, it is not necessary to take out each cold storage agent from the packaging member, and it is not necessary to store the cooled cold storage agent in each packaging member. Accordingly, cooling work can conveniently be performed.

In the storage box according to still another aspect of the present disclosure, a portion covering the cold storage agent of the packaging member may be a transparent resin.

Consequently, a melting degree of the cold storage agent can be visually checked through the packaging member.

The storage box according to still another aspect of the present disclosure may further include a physical quantity sensor disposed in the storage box.

Consequently, an environmental situation in the storage box can be monitored and managed.

According to still another aspect of the present disclosure, a storage box includes a wall including a packaging member and a heat transfer body stored in the packaging member. The packaging member includes an opening, the opening being disposed closer to an outer surface of the storage box than the heat transfer body is.

Consequently, the cold storage agent can be inserted from the opening of the packaging member. Further a chill from the cold storage agent spreads over the heat transfer body, and the chill is transferred to an inside of the storage box through the heat transfer body. Thus, the temperature can be more homogeneously maintained in the storage box.

Hereinafter, an exemplary embodiment of the present disclosure will be described with reference to the drawings.

First Exemplary Embodiment

Figure 1:
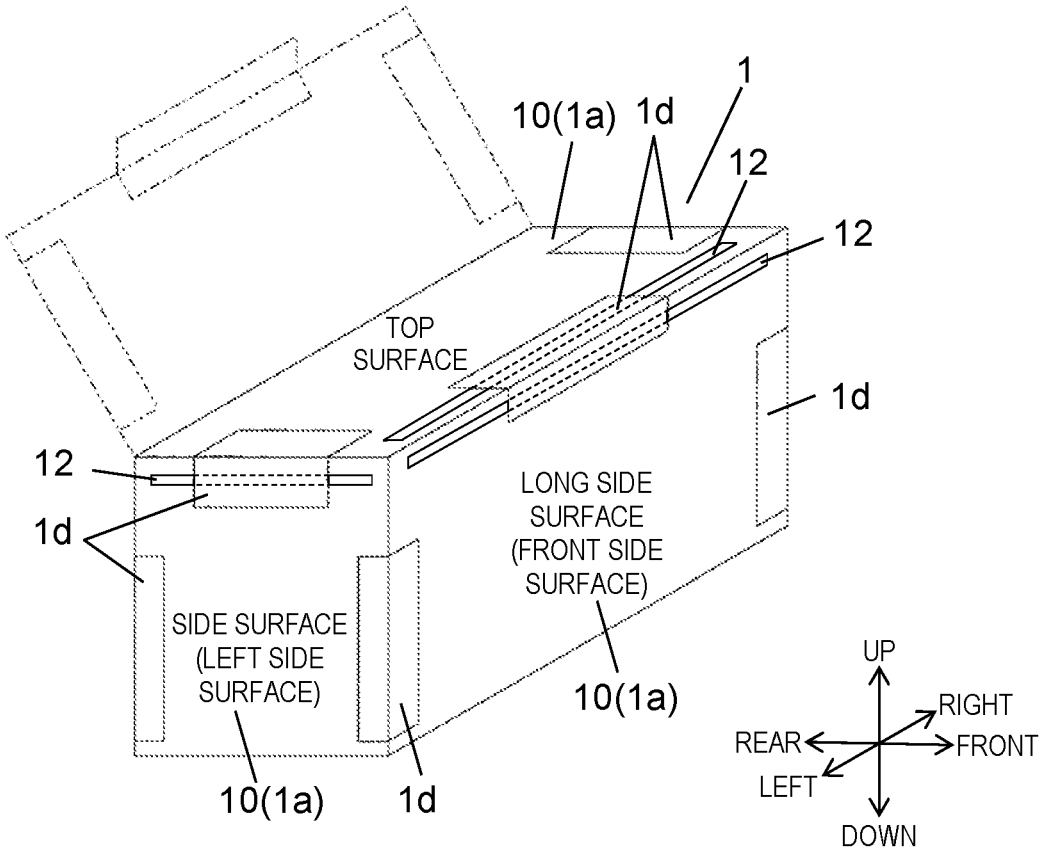
FIG. 1 is a schematic perspective view illustrating a storage box according to a first exemplary embodiment of the present disclosure when viewed from an obliquely upper left.

FIG. 1 is a schematic perspective view illustrating a storage box of a first exemplary embodiment when viewed from an obliquely upper left.

Storage box 1 includes wall 10. In the exemplary embodiment, as illustrated in FIG. 1, wall 10 has a substantially rectangular shape, and storage box 1 has a substantially rectangular parallelepiped shape.

Figure 2:
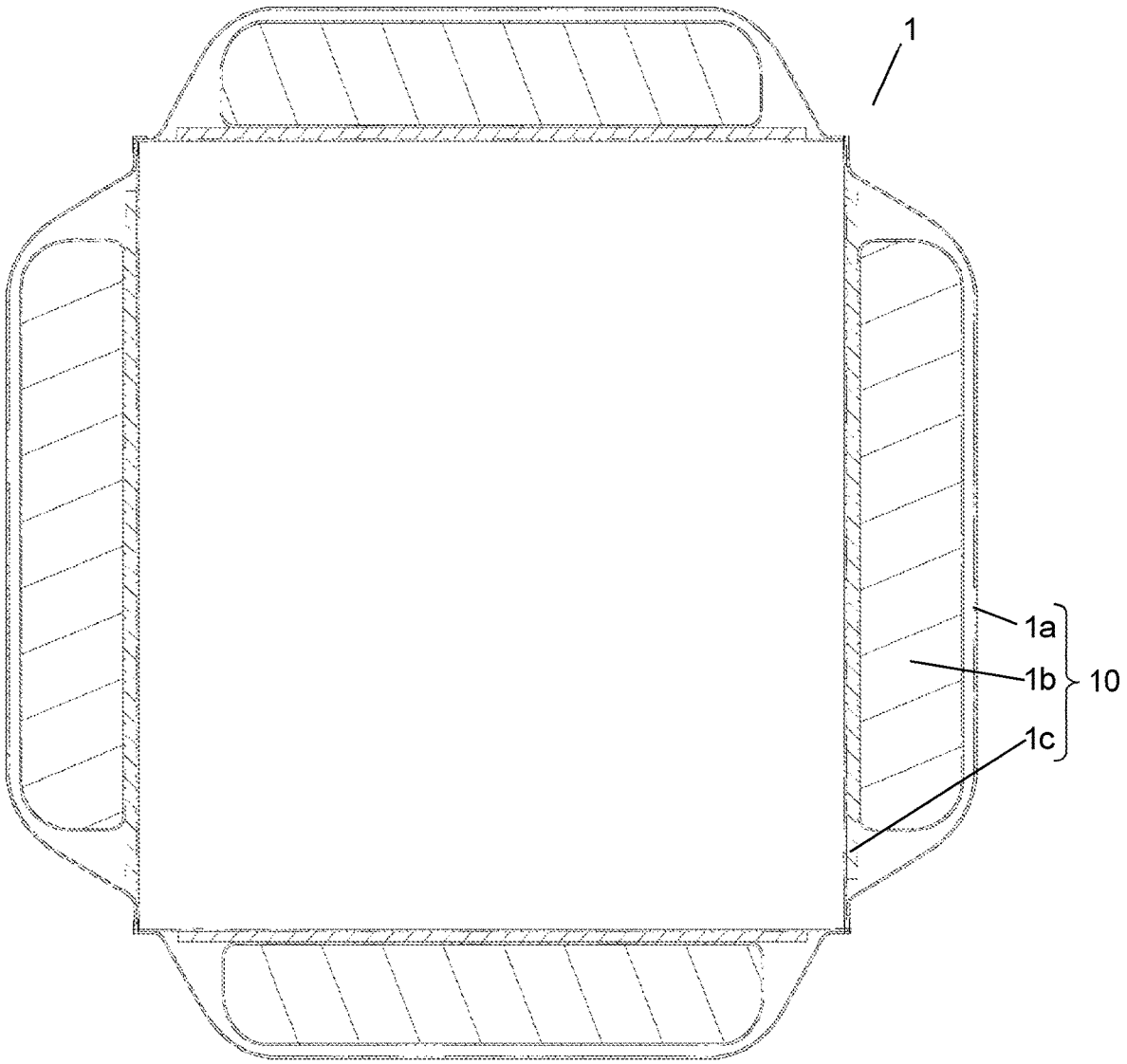
FIG. 2 is a sectional view illustrating the storage box of FIG. 1 when viewed from above.

FIG. 2 is a sectional view illustrating the storage box of FIG. 1 when viewed from above.

As illustrated in FIG. 2, storage box 1 includes an inner space surrounded by wall 10, and a storage object is stored in the inner space.

Wall 10 constituting storage box 1 includes cold storage agent 1*b* and heat transfer body 1*c*. Cold storage agent 1*b* and heat transfer body 1*c* are stored in packaging member 1*a*.

In the exemplary embodiment, the storage box 1 includes six walls 10, and six wall 10 are disposed into a box shape to form the storage box 1.

As illustrated in FIG. 2, in storage box 1 of the exemplary embodiment, cold storage agent 1*b* is disposed closer to an outer surface of storage box 1 than heat transfer body 1*c* is. Consequently, a chill of cold storage agent 1*b* is more homogeneously transferred to the inner space of storage box 1.

When heat transfer body 1*c* is not provided, the chill of cold storage agent 1*b* flows toward a bottom of storage box 1. As a result, a temperature difference between a top surface portion (top surface) and a bottom portion (bottom surface) is increased. In the exemplary embodiment, the chill of cold storage agent 1*b* spreads over heat transfer body 1*c* by disposing heat transfer body 1*c*. Air inside storage box 1 is brought into contact with heat transfer body 1*c* through packaging member 1*a*, whereby the temperatures of the top surface portion and the bottom portion are further homogenized to decrease a temperature distribution. Thus, the temperature can be more homogeneously maintained in storage box 1.

Cold storage agent 1*b* is disposed not at inner surface side of storage box 1 but at outer surface side of storage box 1 as in the exemplary embodiment, so that the inner space of storage box 1 can be constructed with planes. Thus, a user can see in every corner of the inside of storage box 1. For example, when cold storage agent 1*b* is disposed at inner surface side of storage box 1, there is a concern that the user overlooks the existence of a storage object because the storage object is hidden behind cold storage agent 1*b*. In particular, when the storage object is a small medicine bottle, the overlooking is easily generated. On the other hand, in storage box 1 of the exemplary embodiment, the stored medicine bottle or the like is not hidden behind the cold storage agent, and the inner space of storage box 1 has high visibility.

Additionally, in storage box 1 of the exemplary embodiment, at least a portion covering cold storage agent 1*b* in packaging member 1*a* is a transparent resin. Consequently, a melting degree of cold storage agent 1*b* can be visually checked through packaging member 1*a*.

When the temperature is managed, it is important to perceive the melting degree of the cold storage agent. Meanwhile, when storage box 1 is open to check the state of the cold storage agent inside storage box 1, the temperature of the inner space is raised. By opening storage box 1, unnecessary vibration or light may be provided to the medicines or the like stored in storage box 1.

In storage box 1 of the exemplary embodiment, the melting degree of cold storage agent 1*b* can visually be checked through packaging member 1*a* without opening storage box 1. Thus, a user's sense of unease that the melting degree of cold storage agent 1*b* cannot be checked can be eliminated.

Metal (for example, aluminum, copper) or resin (for example, polypropylene, ABS resin) can be used as heat transfer body 1*c*. Preferably, a material having higher conductivity is used as heat transfer body 1*c*.

Figure 3:
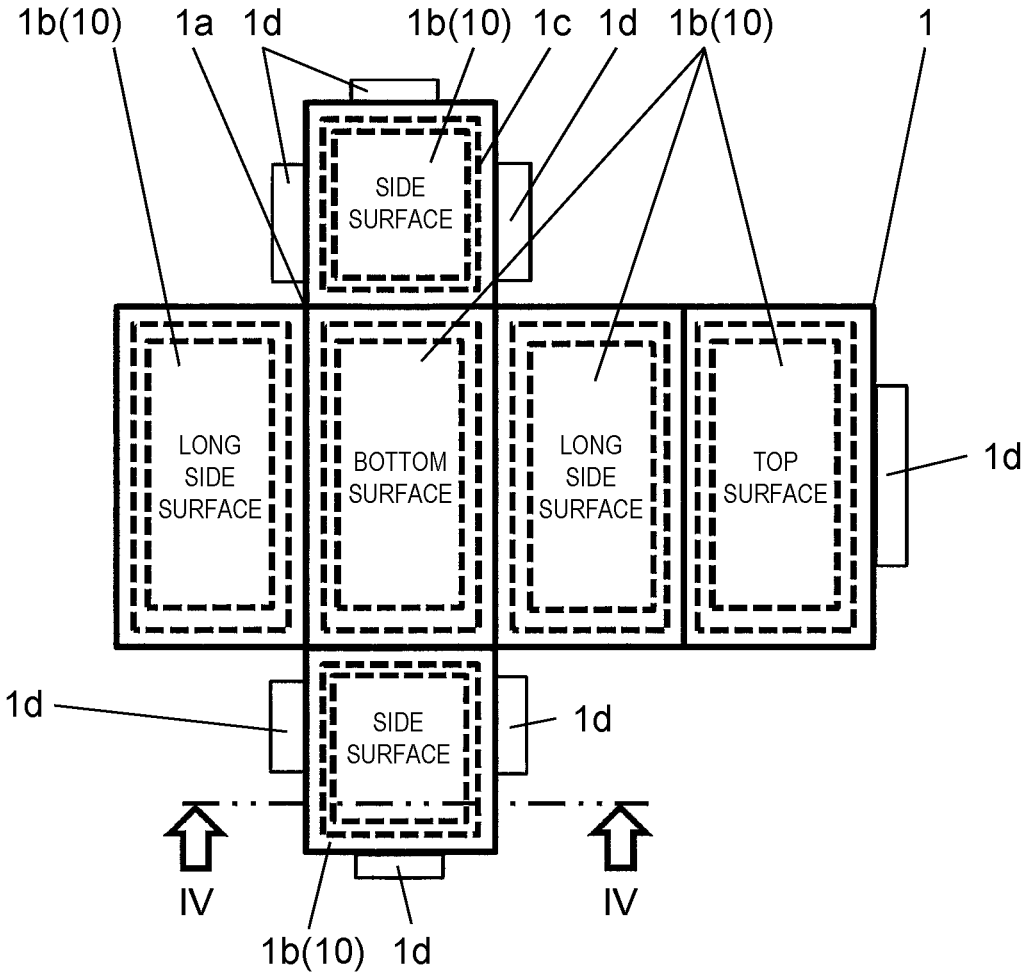
FIG. 3 is a developed view illustrating the storage box of FIG. 1.
Figure 4:
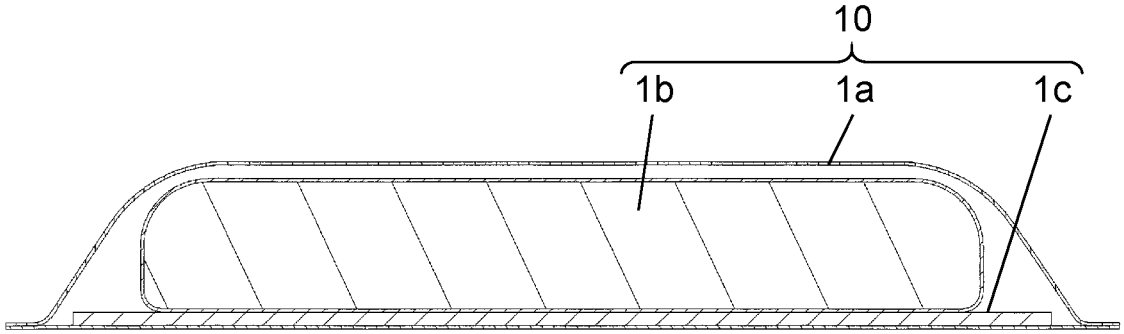
FIG. 4 is a sectional view taken along a line IV-IV of the storage box of FIG. 3.

FIG. 3 is a developed view illustrating the storage box of FIG. 1. FIG. 4 is a sectional view taken along a line Iv-Iv of the storage box of FIG. 3.

As illustrated in FIG. 3, heat transfer body 1*c* of the exemplary embodiment has a substantially rectangular shape. Cold storage agent 1*b* of the exemplary embodiment has a substantially rectangular parallelepiped shape. As illustrated in FIGS. 3 and 4, an area of heat transfer body 1*c* is larger than an area of cold storage agent 1*b* when viewed from a thickness direction of wall 10.

Storage box 1 of the exemplary embodiment can be folded. Storage box 1 can be developed from a box state. Two adjacent walls 10 are detachably coupled together by at least one of packaging member 1*a* of each of adjacent walls 10 or fixing member 1*d*. For example, as illustrated in FIG. 3, wall 10 constituting a front side surface and wall 10 constituting a left side surface, which are two adjacent walls 10, are detachably coupled together by fixing member 1*d* at sides adjacent to each other. Thus, as illustrated in FIG. 3, storage box 1 of the exemplary embodiment can be easily developed or folded by removing fixing member 1*d*. Developed storage box 1 can easily be assembled into a storage box.

A member such as a face tape and a button can be used as fixing member 1*d*. A size of fixing member 1*d* and a coupling place of wall 10 can be selected according to weights and thicknesses of cold storage agent 1*b* and heat transfer body 1*c*.

Two adjacent walls 10 may be detachably coupled together by packaging member 1*a* of each of adjacent walls 10.

Typically, the cold storage agent is cooled in a cooling device before use, and attached to storage box 1 during use of storage box 1. At this point, storage box 1 of the exemplary embodiment can be folded while cold storage agent 1*b* is attached to wall 10.

Figure 5:
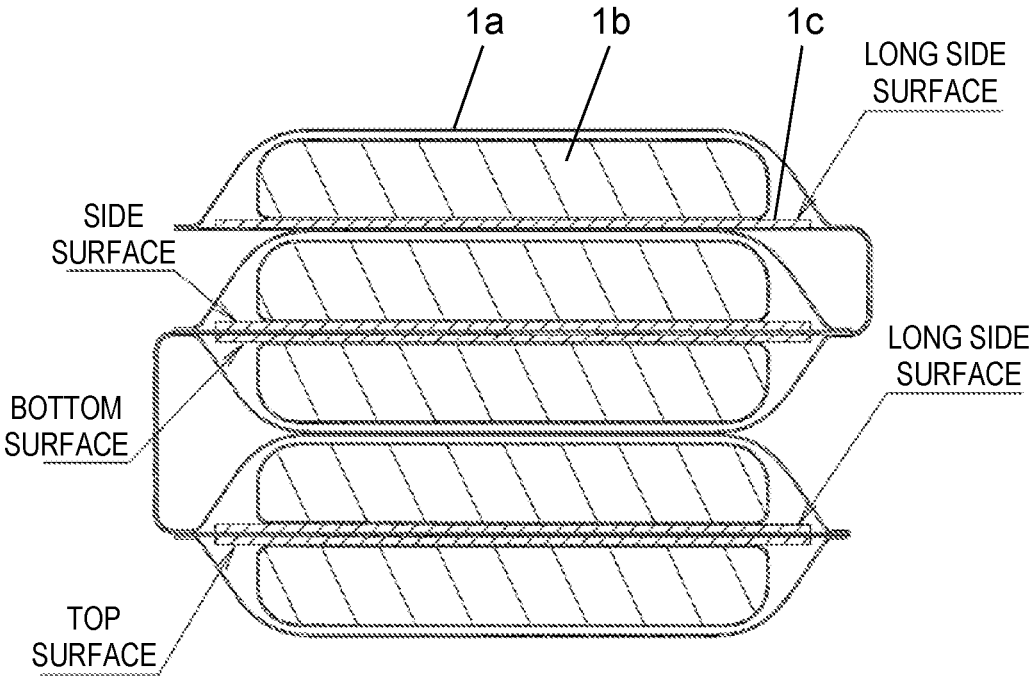
FIG. 5 is a sectional view illustrating a state in which the storage box of the exemplary embodiment is folded.

FIG. 5 is a sectional view illustrating a state in which the storage box of the exemplary embodiment is folded.

As illustrated in FIG. 5, for example, storage box 1 can be folded such that cold storage agents 1*b* are arrayed while overlapping each other in a longitudinal direction (vertical direction). In storage box 1, cold storage agents 1*b* are folded to be arrayed in two rows and to overlap each other in the longitudinal direction, which suppresses a height of storage box 1 in the folded state. Consequently, even if a height of an object stored in the cooling device has strict restriction, storage box 1 can be stored in the cooling device. As illustrated in FIG. 3, storage box 1 can be put in the cooling device while being developed, or a plurality of developed storage boxes 1 can be put in the cooling device while overlapping each other.

In storage box 1 of the exemplary embodiment, it is not necessary to take out each cold storage agent from the packaging member, and it is not necessary to store the cooled cold storage agent in each packaging member. Thus, cooling work of the cold storage agent can be conveniently and efficiently performed.

As illustrated in FIG. 1, packaging member 1*a* of storage box 1 may include opening 12 through which cold storage agent 1*b* is taken in and out. For example, it is considered that the cold storage agent is appropriately selected according to the temperature range of the inner space of storage box 1 to be managed, or that maintenance of the cold storage agent is performed. For example, opening 12 is disposed in wall 10. Specifically, opening 12 may be disposed in packaging member 1*a* so as to be opened in an outside direction of storage box 1. In this case, in order to homogenize the temperature inside storage box 1, adhesion (contact tightness) between cold storage agent 1*b* and heat transfer body 1*c* is desirably secured. Thus, when opening 12 is disposed, a fixing member or the like (not illustrated) may be disposed near opening 12 such that opening 12 can be closed. In the example of FIG. 1, opening 12 can be closed by fixing member 1*d*. Consequently, even if opening 12 is disposed, the adhesion between cold storage agent 1*b* and heat transfer body 1*c* can be maintained or improved.

Storage box 1 can also be stored in the cold container. Consequently, the temperature of the storage box can further be homogenized and maintained for a long time.

Figure 6A:
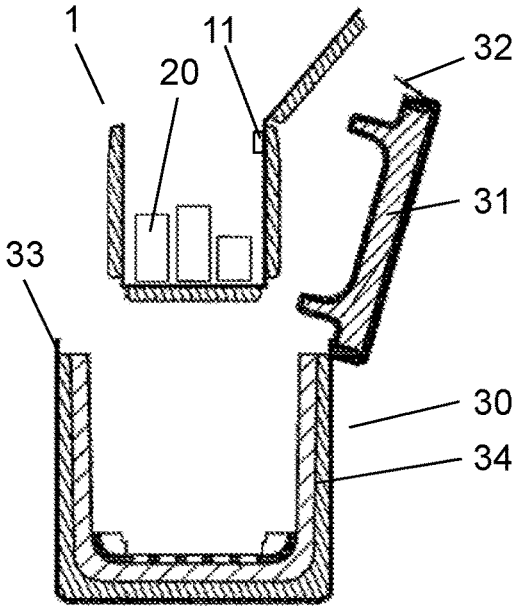
FIG. 6A is a sectional view schematically illustrating a state in which the storage box in which medicines are stored is stored in a cold container.
Figure 6B:
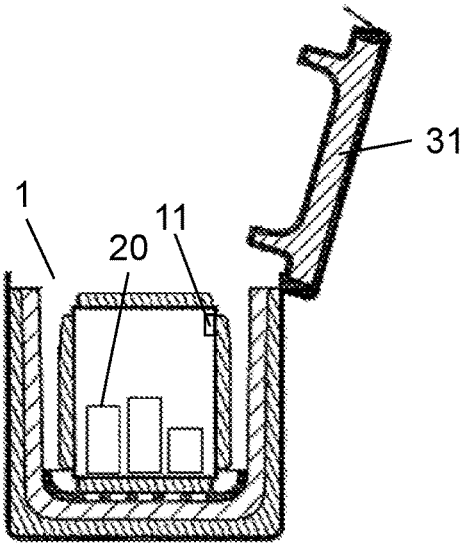
FIG. 6B is a sectional view schematically illustrating the state in which the storage box in which the medicines are stored is stored in the cold container.
Figure 6C:
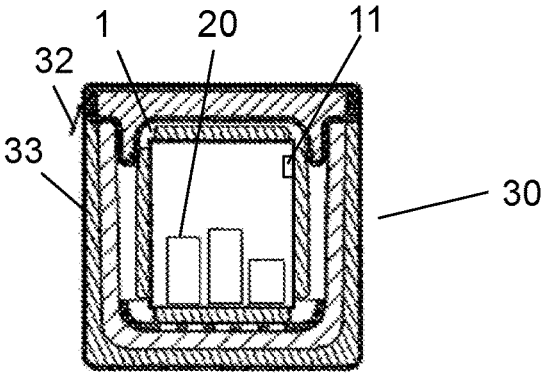
FIG. 6C is a sectional view schematically illustrating the state in which the storage box in which the medicines are stored is stored in the cold container.

FIGS. 6A to 6C are sectional views schematically illustrating a state in which storage box 1 in which medicine bottles are stored is stored in cold container 30.

As illustrated in FIG. 6A, cold container 30 includes main body 34 and a lid 31. Outer case 33 is disposed outside main body 34. Cold container 30 also includes fastener 32 that closes lid 31 and outer case 33.

As illustrated in FIG. 6A, storage box 1 in which medicine bottles 20 are stored is stored in a storage unit of cold container 30. As illustrated in FIG. 6B, the top surface of storage box 1 is closed. As illustrated in FIG. 6C, lid 31 of cold container 30 is closed, and firmly closed by fastener 32 of outer case 33 so as not to be opened.

Storage box 1 may include physical quantity sensor 11 (for example, a single sensor such as a temperature sensor, a vibration sensor, or an optical sensor, or a composite sensor thereof). Consequently, an environmental change in storage box 1 can be recorded during transportation. When the temperature sensor is provided as physical quantity sensor 11, for example, the temperature sensor may be disposed in a region (for example, an upper portion of an inner wall of storage box 1) where the temperature is considered to be highest in the temperature distribution of storage box 1. Storage box 1 may further include a wired or wireless communication unit for transmitting data measured by physical quantity sensor 11 to an external device.

For the wired communication unit, a cable extending from physical quantity sensor 11 may be disposed to be laid out on the top surface of storage box 1, and to be drawn around to the outside of storage box 1 from a gap in a coupling portion where adjacent walls 10 are coupled together.

For the wireless communication unit, a resin member is preferably used as a material for heat transfer body 1*c* in consideration of influence of shielding of a radio wave.

As described above, according to the present disclosure, the temperature can be more homogeneously maintained inside the storage box. Consequently, the present disclosure is applicable to a storage box, a cold container, and the like that are used to transport an investigational drug, blood, or a specimen which requires a storage environment in a specific temperature range.

What is claimed is:

1. A storage box comprising a wall including: a packaging member; and a heat transfer body and a cold storage agent that are stored in the packaging member, wherein the heat transfer body is made of metal or resin, the cold storage agent is disposed closer to an outer surface of the storage box than the heat transfer body is, an area of the heat transfer body is larger than an area of the cold storage agent when viewed from a thickness direction of the wall, the heat transfer body and the cold storage agent are contacting tightly, the packaging member and the heat transfer body are contacting directly, and the packaging member has a hollow space inside.

2. The storage box according to claim 1, further comprising at least two walls adjacent to each other, the at least two walls being the wall, and the at least two walls are detachably attached together at sides adjacent to each other by the packaging member of each of the at least two walls or a fixing member.

3. The storage box according to claim 1, wherein a portion covering the cold storage agent of the packaging member is a transparent resin.

4. The storage box according to claim 1, further comprising a physical quantity sensor disposed in the storage box.

5. The storage box according to claim 4, further comprising a wired or wireless communication unit to transmit data measured by the physical quantity sensor to an external device.

6. The storage box according to claim 4, further comprising a wireless communication unit to transmit data measured by the physical quantity sensor to an external device, and wherein the heat transfer body is made of resin.

7. The storage box according to claim 4, wherein the physical quantity sensor is disposed at an upper portion of the storage box.

8. The storage box according to claim 1, wherein the packaging member includes an opening, the opening being disposed closer to the outer surface of the storage box than the heat transfer body is.

9. The storage box according to claim 1, wherein a surface of the wall configuring an inner space of the storage box is a plane surface.

* * * * *